US007066682B2

(12) United States Patent
Hester

(10) Patent No.: US 7,066,682 B2
(45) Date of Patent: Jun. 27, 2006

(54) VEHICLES AND METHODS FOR SOIL COMPACTION AND LOADING

(76) Inventor: Al Hester, 226 Fern Creek Dr., Dawsonville, GA (US) 30534

( * ) Notice: Subject to any disclaimer, the term of this patent is extended or adjusted under 35 U.S.C. 154(b) by 135 days.

(21) Appl. No.: 10/792,299

(22) Filed: Mar. 3, 2004

(65) Prior Publication Data

US 2005/0194154 A1 Sep. 8, 2005

(51) Int. Cl.
*E01C 19/23* (2006.01)

(52) U.S. Cl. ..... 404/129; 404/124

(58) Field of Classification Search ..... 404/121–126, 404/129; 172/1, 409, 443, 444; 37/411
See application file for complete search history.

(56) References Cited

U.S. PATENT DOCUMENTS

| | | | | |
|---|---|---|---|---|
| 1,933,679 | A | 11/1933 | Nicewander et al. | |
| 2,589,829 | A * | 3/1952 | Le Tourneau | 404/125 |
| 3,085,484 | A | 4/1963 | McAdams et al. | |
| 3,259,036 | A | 7/1966 | Peterson et al. | |
| 3,450,013 | A | 6/1969 | Peterson | |
| 3,823,983 | A | 7/1974 | Peterson | |
| 3,922,106 | A | 11/1975 | Caron et al. | |
| 3,988,071 | A | 10/1976 | Cochran et al. | |
| 4,530,620 | A | 7/1985 | McCartney | |
| D305,337 | S | 1/1990 | Plummer | |
| 5,147,011 | A * | 9/1992 | Hvolka | 37/411 |
| 5,360,288 | A | 11/1994 | O'Neill et al. | |
| 5,676,493 | A | 10/1997 | Brockway | |
| 6,796,762 | B1 * | 9/2004 | Vicars et al. | 414/685 |
| 6,860,707 | B1 * | 3/2005 | Roan et al. | 414/723 |
| 6,863,144 | B1 * | 3/2005 | Brandt et al. | 180/333 |
| 2002/0070038 | A1 * | 6/2002 | Hubbard | 173/184 |
| 2004/0146389 | A1 * | 7/2004 | Bares et al. | 414/722 |

* cited by examiner

*Primary Examiner*—Thomas B. Will
*Assistant Examiner*—Alexandra Pechhold
(74) *Attorney, Agent, or Firm*—Withers & Keys, LLC

(57) ABSTRACT

Vehicles and methods provide for a single vehicle that has both loading ability to grade and otherwise move dirt while also having the ability to compact soil. One or more compaction wheels are included on a vehicle such as a skid steer loader. Wiper bars are also included to clean circumferential grooves defined by compaction studs located about the periphery of the compaction wheels. The compaction studs have a substantially flat ground-contacting surface with a surface area significantly smaller than the typical contact area of a tire, which results in increased pressure to provide for soil compaction. A loader bucket of the vehicle may be elevated to various heights to alter the weight distribution applied to the compaction wheels and/or may be filled with material such as dirt to control the overall vehicle weight applied to the compaction wheels.

8 Claims, 3 Drawing Sheets

VEHICLES AND METHODS FOR SOIL COMPACTION AND LOADING

TECHNICAL FIELD

The present invention is related to vehicles that compact soil. More particularly, the present invention is related to vehicles that have the combined ability to both load dirt and compact soil.

BACKGROUND

Areas must often be graded or otherwise be re-shaped by construction equipment such as a front-end loader to achieve a particular slope and appearance. However, once graded the soil must be compacted to a stable state so that the graded area is less susceptible to erosion and is ready to become the footing of a structure to be built on the soil. Thus, two distinct activities, grading and compacting, must be performed at a given site. These two distinct activities typically require two distinct vehicles on the job site, namely a loader and a compactor.

The two distinct vehicles per job site present a dilemma. There are many costs associated with owning, operating, and maintaining two vehicles instead of one. Each vehicle itself is a significant cost in the range of at least tens of thousands of dollars. Furthermore, there is twice the maintenance and additional operating crew associated with operating two vehicles per job site. Therefore, it is costly to provide loading and compacting services using two distinct vehicles.

SUMMARY

Embodiments of the present invention address these issues and others. These embodiments provide vehicles and methods that combine the ability to load dirt as well as the ability to compact soil. Accordingly, only a single vehicle is necessary per job site to complete both the grading and compacting tasks.

One embodiment is a soil compactor vehicle. The vehicle includes a frame and a loading bucket coupled to the frame. The vehicle further includes a control system operable to control the loading bucket position relative to the frame. A plurality of compaction wheels are coupled to the frame. The compaction wheels include radially extending compaction studs that have a substantially flat ground contacting surface, and the compaction studs are spaced about the periphery of the compaction wheels and define circumferential grooves on the compaction wheels. A plurality of wiper bars are fixed in relation to the frame and are positioned so as to extend into the circumferential grooves defined on the compaction wheels by the compaction studs. An engine is operable to drive one or more of the plurality of compaction wheels.

Another embodiment is specifically a skid steer loader that includes a frame and a loading bucket coupled to the frame. A control system is operable to control the loading bucket position relative to the frame. Two front compaction wheels are coupled to and are on opposite sides of the frame. Likewise, two rear compaction wheels are coupled to and are on opposite sides of the frame. The two front and two rear compaction wheels include radially extending compaction studs that have a substantially flat ground contacting surface, and the compaction studs are spaced about the periphery of the two front and two rear compaction wheels and define circumferential grooves on the two front and two rear compaction wheels. A plurality of wiper bars are fixed in relation to the frame and are positioned so as to extend into the circumferential grooves defined on the two front and two rear compaction wheels by the compaction studs. An engine is operable to drive one or more of the plurality of compaction wheels, and a skid steering system is operable to control the rotation of the two front and two rear compaction wheels to steer the skid steer loader.

Another embodiment is a method of compacting soil utilizing a soil compaction vehicle that includes a loader bucket and that includes at least one compaction wheel that has radially extending compaction studs spaced about the periphery. The method involves loading material into the loader bucket to increase the total weight of the soil compaction vehicle. The method further involves driving the soil compaction vehicle with the material loaded into the bucket such that the at least one compaction wheel rolls over the soil to be compacted.

Another embodiment is a method of compacting soil utilizing a soil compaction vehicle that includes a loader bucket and that includes at least one compaction wheel having radially extending compaction studs spaced about the periphery. The method involves elevating the loader bucket to alter a weight distribution relative to the at least one compaction wheel. The method further involves driving the soil compaction vehicle with the loader bucket elevated such that the at least one compaction wheel rolls over the soil to be compacted.

DETAILED DESCRIPTION

Embodiments of the present invention provide for a machine that has both loader and compactor capabilities by including a loader bucket as well as compaction wheel(s) that can be substituted for conventional tire(s) such as when grading is completed and the soil is ready for compaction. Thus, the single machine may perform both loader tasks and compaction tasks at a job site. Furthermore, the loader bucket and compaction wheel(s) may be used in conjunction when the soil is being compacted. Material may be loaded into the loader bucket to increase the overall vehicle weight and pressure applied by the compaction wheel(s) and/or the loader bucket may be elevated to alter the weight distribution relative to the compaction wheel(s) so as to control the amount of soil compaction that is occurring.

Figure 1:
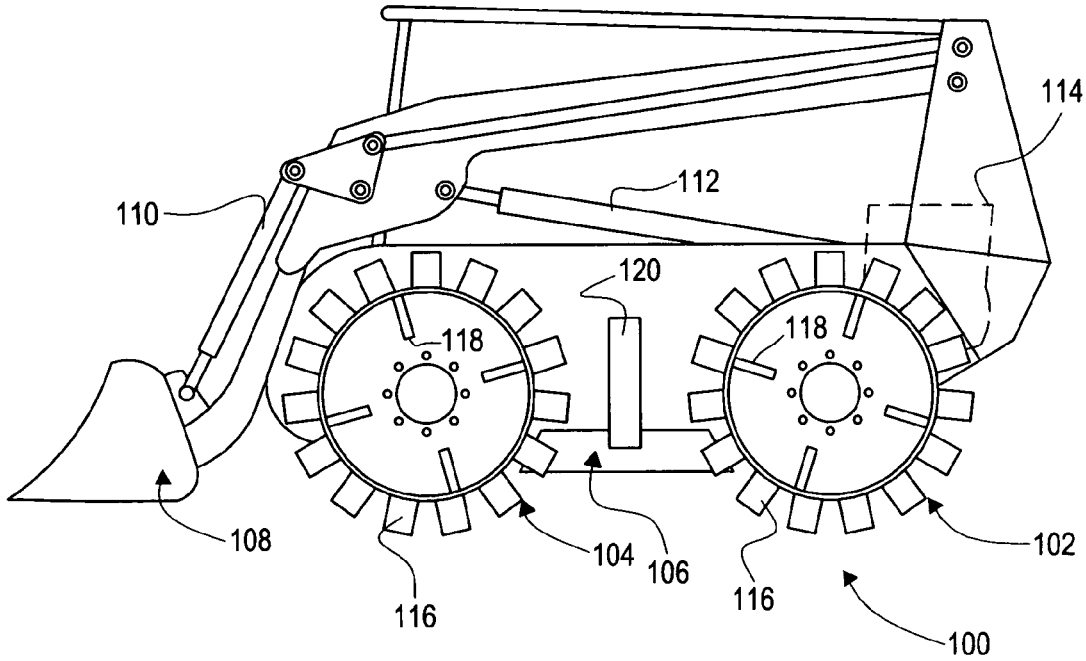
FIG. 1 is a side view of a skid steer loader with compaction wheel according to an embodiment of the present invention.
Figure 2:
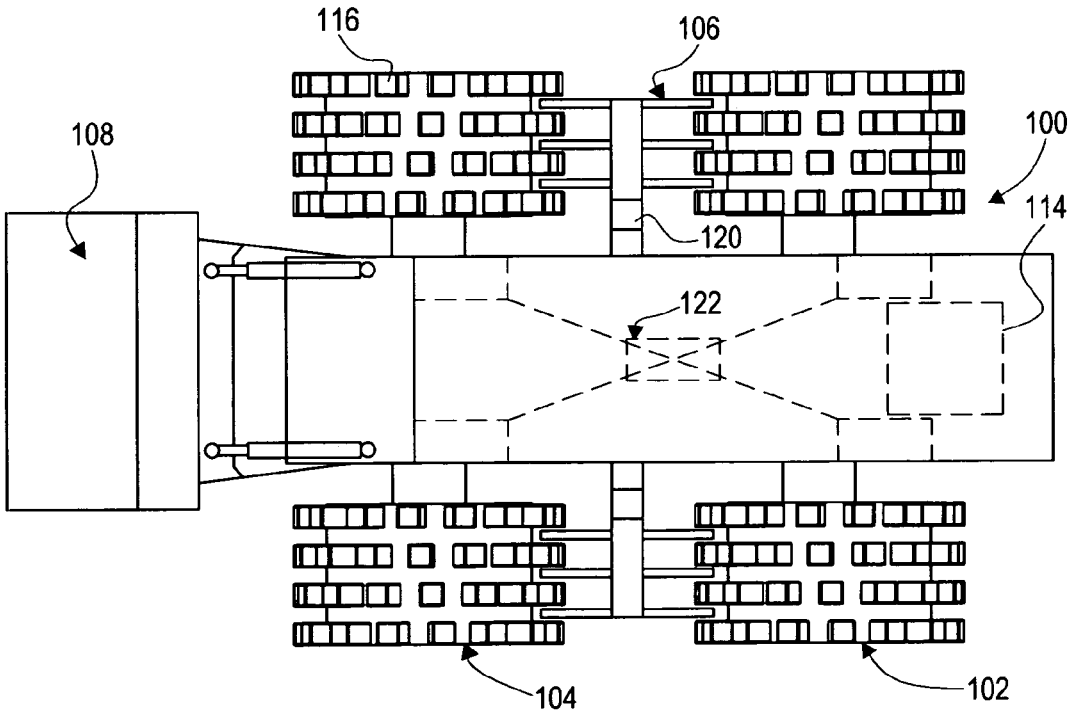
FIG. 2 is a top view of the skid steer loader of FIG. 1.

FIG. 1 is a side view and FIG. 2 is a top view of one embodiment of the present invention. This particular embodiment is a skid steer loader with compaction ability. However, the skid steer loader of FIGS. 1 and 2 as well as FIGS. 5 and 6, discussed below, is shown only for purposes of illustration. Other types of loader vehicles may also form embodiments of the present invention. For example, various wheel loaders such as an articulated wheel loader may also be provided with compaction ability according to embodiments of the present invention.

As shown in FIGS. 1 and 2, the soil compactor vehicle embodiment 100 includes compactor wheels 102, 104 on both sides in place of conventional wheels having rubber tires. The four compactor wheels 102, 104 of this embodiment allow for compaction to occur at each wheel. However, it will be appreciated that other embodiments may provide for fewer than four compactor wheels such as where one or more conventional wheels with rubber tires are left on the machine while the remaining wheel locations are provided with the compactor wheel(s).

The compactor wheels 102, 104 are provided with radially extending studs 116 that are spaced about the periphery of the compactor wheel. The studs 116 have a substantially flat ground contacting surface, as opposed to a pointed surface, so that the soil is properly compacted rather than punctured. The studs 116 contact and penetrate the soil as the vehicle 100 moves, with the flat surface of each stud 116 applying pressure to the soil to cause compaction.

The studs 116 of this embodiment are axially offset into four circumferential rows resulting in three circumferential grooves between each of the circumferential rows of studs 116. Because the studs 116 are spaced about the periphery, when the studs 116 penetrate the soil, the soil may clump and wedge between the studs 116 in the axial and circumferential directions. This soil build-up between the studs 116, if not removed, contacts the ground soil as the studs 116 begin to penetrate and thereby prevents the studs 116 from adequately penetrating the ground soil. Inadequate penetration of the ground soil by the studs 116 leaves the soil in an inadequately compacted state.

To address this problem, the vehicle 100 includes wiper bars 106 that are fixed in place by mounting bars 120. The wiper bars 106 extend into the circumferential grooves between the circumferential rows of studs 116. Thus, as the wheels 102, 104 turn while the vehicle is compacting soil, the wiper bars 106 wipe away any soil build-up occurring in the circumferential grooves. Wiping away this soil build-up in the circumferential grooves also assists in removing the soil build-up occurring in the space between the studs 116 of the same circumferential row.

The compactor wheels 102, 104 may also be provided with support ribs 118 that are spaced around the inside of the compactor wheels 102, 104. These support ribs 118 are more clearly seen in FIG. 3, discussed below.

In addition to the compactor wheels 102, 104 and wiper bars 106, the vehicle 100 also includes loader features that allow the vehicle to perform loader tasks such as grading in addition to performing soil compaction. As with conventional rubber tire loaders, the vehicle 100 has a loader bucket 108 that is coupled to the frame of the vehicle 100 by support arms that are manipulated by a control system. The control system of this embodiment includes hydraulic actuators 110 and 112. Hydraulic actuator 112 alters the elevation of the loader bucket 108, while actuator 110 controls the orientation of the loader bucket 108 that ranges from a dumping position to a hauling position or scooping position.

The vehicle 100 also includes other components of a conventional loader, such as an engine 114 for driving the compactor wheels 102, 104. Additionally, the vehicle 100 includes a steering system 122, which in this embodiment is a conventional skid steer system as is well known in the art that controls the rotation of left versus right side compaction wheels to cause the vehicle 100 to turn to the left or right.

Figure 3:
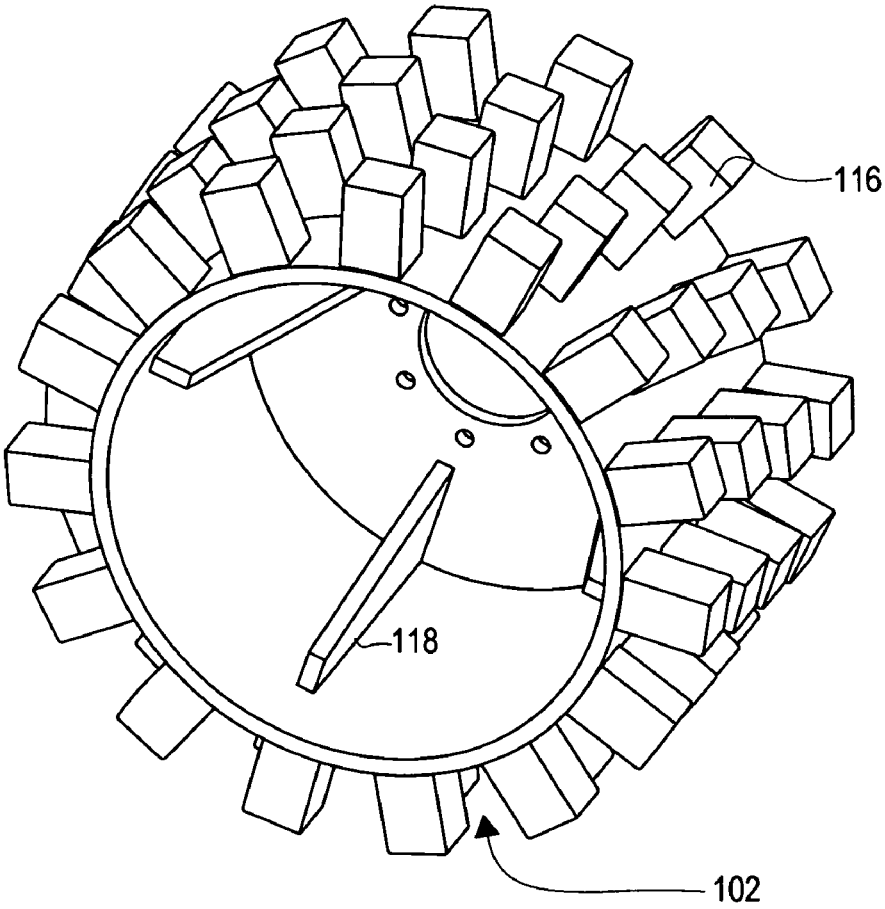
FIG. 3 is a perspective view of a compaction wheel.

FIG. 3 is a perspective view of a compactor wheel 102. The compactor wheel 102 includes the radially extending studs 116 spaced about the periphery. It will be noted that this compactor wheel embodiment 102 includes studs 116 spaced such that studs of one circumferential row are offset circumferentially relative to studs on an adjacent circumferential row. Accordingly, for this embodiment only a single stud 116 of a particular compactor wheel 102 is completely in contact with the soil being compacted at any given time. Thus, the fraction of vehicle weight being supported by the compactor wheel 102 is primarily being applied to the soil by a single stud 116 at any given time, thereby increasing the compaction pressure. It will be appreciated that other spacing of studs 116 is also applicable such as where multiple studs in adjacent circumferential rows may be completely in contact with the soil at the same time.

The support ribs 118 are also visible in FIG. 3. These support ribs provide additional strength to the compactor wheels 102 to prevent the wheels from deforming into a non-round shape. For example, the vehicle 100 may pass over debris or a rigid surface that applies a deforming force to the wheel 102, and the support ribs 118 allow the compaction wheel 102 to resist deformation.

To protect the vehicle 100 and compactor wheel 102, the wheel 102 mounts onto a hub of the vehicle 100 by a center hub mounting hole of the wheel 102 fitting onto a hub of the vehicle 100. Thus, the weight of the vehicle 100 is distributed from the hub to the center hub mounting hole visible in FIG. 3 as opposed to the weight being distributed via the lugs of the hub. The lugs then pass through lug holes visible in FIG. 3 to hold the wheel 102 onto the hub.

The compactor wheel 102 may be made of various materials. However, it has been found that high-grade steel such as that used in road casings is suitable for the round tubular portion while plate steel is suitable for the flat hub mounting portion and support ribs 118. For the skid steer loader example shown, ½ inch thick road casings welded to ½ inch thick plate steel support ribs 118 and ½ inch plate steel hub mounting portions have been used with success. Additional details of one illustrative skid steer example are provided below.

The studs 116 of the compactor wheel 102 may also be made of various materials, but steel is also suitable for this purpose. Typically, the studs 116 may be constructed by utilizing a round or square steel tube cut to a desired length with a plate steel endcap welded on to one end of the tube to form the flat ground contacting surface of the stud 116. The opposite end of the tube may then be welded onto the appropriate location on the periphery of the compactor wheel 102. For the skid steer example shown, 3 inch by 3 inch steel tubing of ¼ inch thickness has been used with success, with a ⅜–½ inch endcap welded onto the tube.

The dimensions chosen for the compactor wheel 102 are dependent upon the particular job to be completed and the size of the vehicle 100. The overall diameter is limited to a range defined by the frame of the vehicle 100. There is typically a maximum diameter imposed by fenders or other portions of the vehicle 100 that extend over the wheels 102, 104. It has been found that utilizing an overall diameter of the compactor wheel 102 that is approximately the same diameter as the rubber tire conventionally used is adequate. This is especially the case if one or more wheels of the vehicle are conventional wheels with rubber tires so as to prevent different ground speeds of each wheel that would stress the drive system of the vehicle 100.

There is typically a minimum height imposed by the amount of ground clearance necessary between the bottom of the vehicle and the soil being compacted. This minimum height set by the necessary ground clearance dictates that the diameter of the road casing used be great enough so that the road casing extends lower than the bottom of the frame. This prevents the frame from dragging in loose material being compacted. Taking into consideration the minimum diameter of the road casing and the maximum diameter the vehicle permits, then the range of lengths of the studs 116 can be found.

The desired length of the studs 116 within this permissible range may be determined by a function of the soil lift (i.e., depth of uncompacted soil sitting atop stable dirt) and the amount of penetration into the soil lift that is desired. For example, it is often desirable to grade a 6–8 inch soil lift and then penetrate over half of the soil lift to properly compact the soil. Thus, a length for the stud 116 might be set at 4–5 inches for such a soil lift, which should typically fall within the allowable range discussed above for a skid steer loader.

The width of the compactor wheel 102 is determined by balancing the rate at which the operator desires to compact the soil against the amount of pressure that is necessary for proper compaction. For a given surface area of a ground contacting surface of each stud 116, the wider the wheel 102 the more likely additional studs or portions of the wheel 102 contact the soil thereby reducing the pressure applied by any single stud 116. However, the wider the wheel 102, the more soil that is compacted by a single pass of the vehicle 100 over the soil. Therefore, the width of the compactor wheel 102 should be narrow enough to properly compact the soil, but not overly narrow.

As one illustrative example, a typical skid steer loader uses a rubber tire having a diameter of about 32 inches. A road casing of about 25 inches in outside diameter mounted on the hub of the vehicle typically provides an acceptable amount of ground clearance for the bottom of the vehicle frame when in loose material. Furthermore, a 6–8 inch lift is often desired with a penetration of just over 50%. Thus, a total stud length (i.e., tube plus endcap) of 4–4½ inches results in the desired penetration for a 6–8 inch lift. This stud length also results in an overall diameter of between 33 inches and 34 inches, which is acceptable in relation to the 32 inch diameter of the conventional rubber tire. Additionally, this example provides a compactor wheel 102 having four circumferential rows of studs 116, each row including 15 studs having a 3 inch by 3 inch footprint each. There is a two inch space in the axial direction between each row (i.e., three circumferential grooves that are each two inches in width). The resulting width of the compactor wheel 102 is 18 inches.

Figure 4:
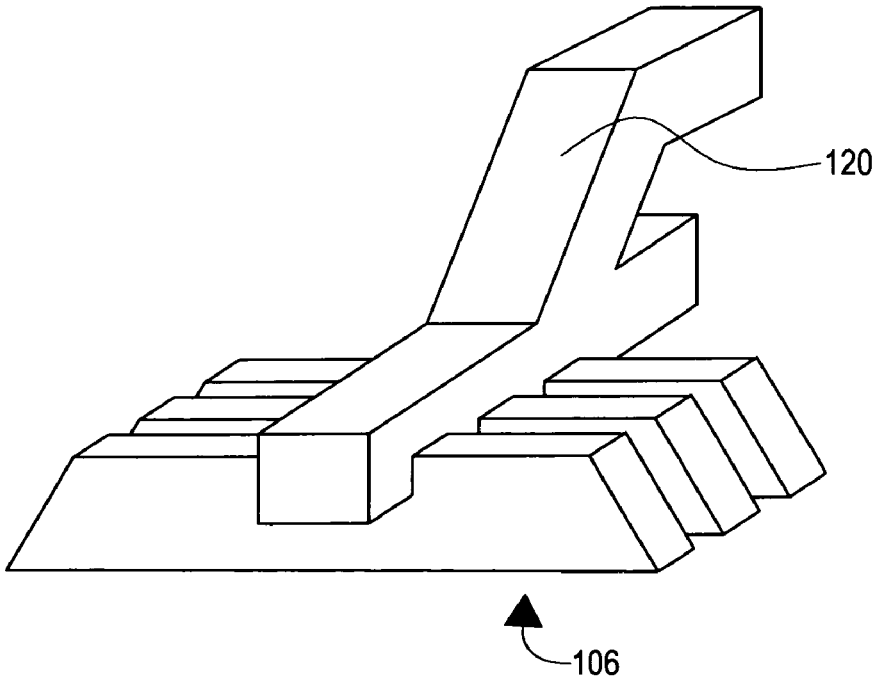
FIG. 4 is a perspective view of a wiper bar assembly.

While the compactor wheel 102 provides the compaction pressure, the soil build-up must be prevented in order to continue applying the necessary compaction penetration and pressure at each stud 116. FIG. 4 shows one embodiment of a wiper bar assembly used in conjunction with the compactor wheel 102 that wipes away the soil build-up as the vehicle 100 continuously passes over the soil. The wiper bar assembly includes a mounting bar 120 that is attached to the frame or other portion of the vehicle so that the individual wiper bars 106 attached to the mounting bar 120 are suspended adjacent the compactor wheel to be cleaned. The wiper bars 106 extend into the circumferential grooves defined by the circumferential rows of studs 116.

In the embodiment shown, the compactor wheel 102 includes four circumferential rows of studs defining three circumferential grooves, so there are 3 wiper bars per compactor wheel. Also as shown for the skid steer loader example, a single bar extends into a groove of a front compactor wheel 104 and also extends into a groove of a rear compactor wheel 102. It will be appreciated that the wiper bars extending into the grooves of the front compactor wheels may be distinct from those wiper bars extending into the grooves of the rear compactor wheels, especially for loaders that are not skid steer where the front and rear compactor wheels are not in fixed positions relative to one another.

The wiper bars 106 and mounting bar 120 may be made of various materials. Tubular steel has been used with success. Furthermore, the wiper bars may be located at various positions relative to the compactor wheel 102 and may have various shapes to best accommodate the mounting position. As shown for this embodiment, the wiper bars 106 are positioned lower than the vertical center of the compactor wheels 102, 104. The wiper bars 106 have angled ends to allow the wiper bars to extend well into the circumferential grooves without contacting the round casing of each compactor wheel. Furthermore, the wiper bars 106 are slightly narrower than the circumferential grooves defined by the studs 116 so that the wiper bars 106 do not contact the studs 116.

Figure 5:
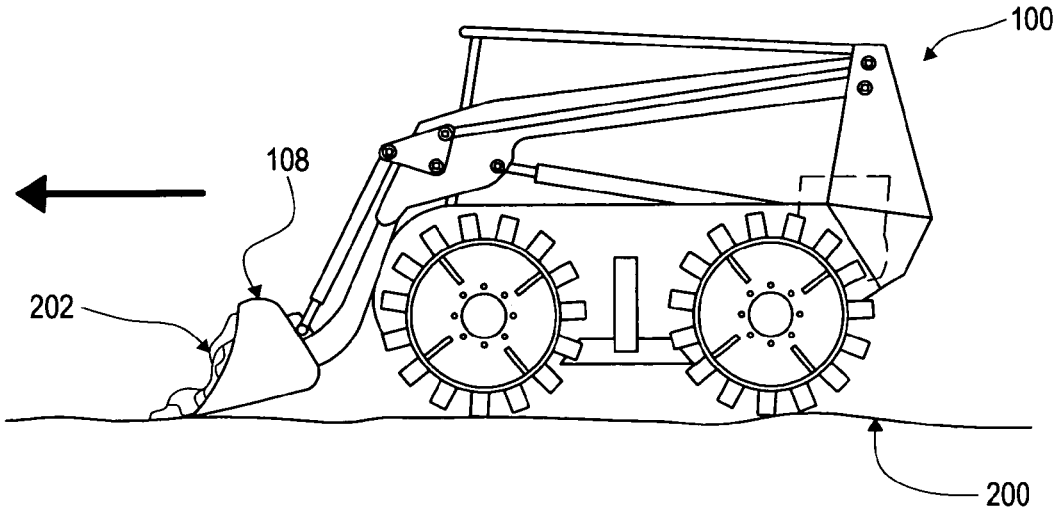
FIG. 5 illustrates loading dirt or other material into the loader bucket of the skid steer loader with compaction wheels.

FIG. 5 shows the vehicle 100 in operation to compact the soil 200. The vehicle may be driven back and forth over the soil such that the compaction wheel(s) roll over the soil to compact it. Proper compaction may require that the compaction wheel(s) traverse the same area of soil multiple times. The speed at which the vehicle 100 should travel while compacting the soil varies with soil conditions, and experimentation with a given soil condition reveals the proper speed. However, it has been found that a speed ranging from one to five miles per hour is satisfactory for most soil conditions.

The studs 116 should fully penetrate into the soil to provide the compaction. Depending upon the soil conditions including soil density and moisture content, the weight of the vehicle 100 may be enough to properly compact the soil. For a typical skid steer loader, the vehicle weighs approximately 6500 pounds and this is often adequate to compact the soil. However, there are times when this weight will not be adequate.

Various techniques may be utilized to improve the compaction when the weight of the vehicle 100 alone is not adequate. As shown in FIG. 5, the vehicle 100 may proceed to scrape the loader bucket 108 along the ground to load soil 202 into the bucket 108. For a typical skid steer loader, a full bucket of soil adds on the order of 1000 pounds to the overall vehicle weight. Alternatively, the loader bucket 100 may be filled in other manners with other material such as manually placing weights within the loader bucket 100 until the desired weight is achieved. Of course, care should be exercised not to exceed the maximum weight that is specified by the operator's manual for loader bucket 108 of the vehicle 100.

Figure 6:
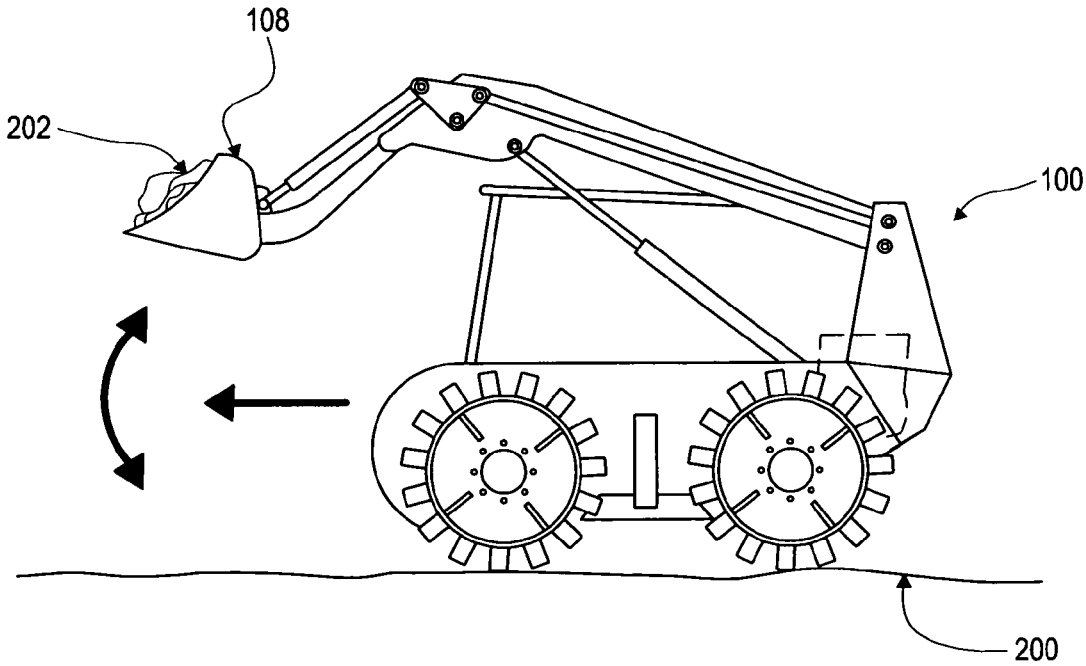
FIG. 6 illustrates elevating the loader bucket of the skid steer loader with compaction drums to alter the weight distribution applied to the compaction wheels.

Another technique that may be utilized is to elevate the loader bucket 108 as shown in FIG. 6. As the loader bucket 108 elevates, the center of gravity of the vehicle 100 is altered, which causes the weight to be distributed differently on the compaction wheel(s). The loader bucket 108 may be elevated without any material placed into the loader bucket 108 to slightly alter the center of gravity to increase the weight distributed over the front compactor wheel(s) 104. The elevation of the loader bucket 108 can be readjusted as necessary to alter the weight distribution as desired while repeatedly passing back and forth over the soil to be compacted.

For a more extreme result, the loader bucket 108 may first be loaded with material 202 as described above with reference to FIG. 5 and then be elevated as desired. This places even more of the total vehicle weight over the front compactor wheel(s) 104 to provide the most pressure to the soil for compaction. Again, the elevation of the loader bucket 108 may be readjusted as necessary while repeatedly passing back and forth over the soil.

When elevating the loader bucket 108 with or without material 202, extreme caution must be exercised while driving the vehicle 100 over the soil to be compacted because the change in the center of gravity causes the vehicle 100 to be susceptible to tipping over. The amount of weight added to the loader bucket 108, the degree of elevation of the loader bucket 108 for the current vehicle speed and bucket weight, and the overall operating speed of the vehicle 100 should never exceed the maximum values specified by the operator's manual. Furthermore, the loader bucket 108 should be brought to a low position when the vehicle 100 is about to be stopped because the inertia of the loader bucket 108 increases the likelihood of the vehicle 100 tipping over at that time.

It has been found that moist soil conditions generally do not call for the loader bucket 108 to be elevated. However, when the soil has a relatively low moisture content, elevating the loader bucket 108 will often increase the degree of compaction, especially when the loader bucket 108 is first loaded with material 202.

While the invention has been particularly shown and described with reference to various embodiments thereof, it will be understood by those skilled in the art that various other changes in the form and details may be made therein without departing from the spirit and scope of the invention.

What is claimed is:

1. A soil compactor vehicle, comprising:

a frame;

a loader bucket movably coupled to the frame;

a control system operable to control the loader bucket position relative to the frame;

a plurality of compaction wheels coupled to the frame, the compaction wheels including radially extending compaction studs that have a substantially flat ground contacting surface, the compaction studs being spaced about the periphery of the compaction wheels and defining circumferential grooves on the compaction wheels;

a plurality of wiper bars fixed in relation to the frame and being positioned so as to extend into the circumferential grooves defined on the compaction wheels by the compaction studs;

an engine operable to drive one or more of the plurality of compaction wheels;

wherein the plurality of compaction wheels comprises two front compaction wheels on opposite sides of the frame and two rear compaction wheels on opposite sides of the frame, the soil compactor vehicle further comprising:

a first mounting bar extending from a first side of the frame, a first set of the plurality of wiper bars being mounted to the first mounting bar such that at least a first subset of the wiper bars mounted to the first mounting bar extend into the circumferential grooves of a first front compaction wheel and such that at least a second subset of the wiper bars mounted to the first mounting bar extend into the circumferential grooves of a first rear compaction wheel; and a second mounting bar extending from a second side of the frame opposite the first side of the frame, a second set of the plurality of wiper bars being mounted to the second mounting bar such that at least a first subset of the wiper bars mounted to the second mounting bar extend into the circumferential grooves of a second front compaction wheel and such that at least a second subset of the wiper bars mounted to the second mounting bar extend into the circumferential grooves of a second rear compaction wheel.

2. The soil compactor vehicle of claim 1, wherein at least one of the wiper bars mounted to the first mounting bar extends into a circumferential groove of the first front compaction wheel and into a circumferential groove of the first rear compaction wheel and wherein at least one of the wiper bars mounted to the second mounting bar extends into a circumferential groove of the second front compaction wheel and into a circumferential groove of the second rear compaction wheel.

3. The soil compactor vehicle of claim 1, wherein the first mounting bar extends from an area of the frame between the first front compaction wheel and the first rear compaction wheel and wherein the second mounting bar extends from an area of the frame between the second front compaction wheel and the second rear compaction wheel.

4. The soil compactor vehicle of claim 1, wherein the soil compactor vehicle comprises a skid steering system.

5. The soil compactor vehicle of claim 1, wherein the soil compactor vehicle comprises a skid steering system.

6. A skid steer loader, comprising:

a frame;

a loader bucket movably coupled to the frame;

a control system operable to control the loader bucket position relative to the frame;

two front compaction wheels coupled to and on opposite sides of the frame and two rear compaction wheels coupled to and on opposite sides of the frame, the two front and two rear compaction wheels including radially extending compaction studs that have a substantially flat ground contacting surface, the compaction studs being spaced about the periphery of the two front and two rear compaction wheels and defining circumferential grooves on the two front and two rear compaction wheels;

a plurality of wiper bars fixed in relation to the frame and being positioned so as to extend into the circumferential grooves defined on the two front and two rear compaction wheels by the compaction studs;

an engine operable to drive one or more of the plurality of compaction wheels;

a skid steering system operable to control the rotation of the two front and two rear compaction wheels to steer the skid steer loader;

a first mounting bar extending from a first side of the frame, a first set of the plurality of wiper bars being mounted to the first mounting bar such that at least a first subset of the wiper bars mounted to the first mounting bar extend into the circumferential grooves of a first front compaction wheel and such that at least a second subset of the wiper bars mounted to the first mounting bar extend into the circumferential grooves of a first rear compaction wheel; and a second mounting bar extending from a second side of the frame opposite the first side of the frame, a second set of the plurality of wiper bars being mounted to the second mounting bar such that at least a first subset of the wiper bars mounted to the second mounting bar extend into the circumferential grooves of a second front compaction wheel and such that at least a second subset of the wiper bars mounted to the second mounting bar extend into the circumferential grooves of a second rear compaction wheel.

7. The skid steer loader of claim 6, wherein at least one of the wiper bars mounted to the first mounting bar extends into a circumferential groove of the first front compaction wheel and into a circumferential groove of the first rear compaction wheel and wherein at least one of the wiper bars mounted to the second mounting bar extends into a circumferential groove of the second front compaction wheel and into a circumferential groove of the second rear compaction wheel.

8. The skid steer loader of claim 6, wherein the first mounting bar extends from an area of the frame between the first front compaction wheel and the first rear compaction wheel and wherein the second mounting bar extends from an area of the frame between the second front compaction wheel and the second rear compaction wheel.

* * * * *